US010612868B2

(12) United States Patent
Thaggard

(10) Patent No.: US 10,612,868 B2
(45) Date of Patent: Apr. 7, 2020

(54) COIL BRUSH

(71) Applicant: Charles E Thaggard, Hattiesburg, MS (US)

(72) Inventor: Charles E Thaggard, Hattiesburg, MS (US)

( * ) Notice: Subject to any disclaimer, the term of this patent is extended or adjusted under 35 U.S.C. 154(b) by 439 days.

(21) Appl. No.: 15/387,642

(22) Filed: Dec. 21, 2016

(65) Prior Publication Data

US 2018/0172371 A1 Jun. 21, 2018

(51) Int. Cl.

| | |
|---|---|
| ***F28G 1/02*** | (2006.01) |
| ***A46B 9/02*** | (2006.01) |
| ***A46B 3/02*** | (2006.01) |
| ***B25G 1/06*** | (2006.01) |
| ***A46B 5/00*** | (2006.01) |
| ***B08B 1/00*** | (2006.01) |

(52) U.S. Cl.

CPC ..... *F28G 1/02* (2013.01); *A46B 3/02* (2013.01); *A46B 5/0012* (2013.01); *A46B 5/0058* (2013.01); *A46B 9/025* (2013.01); *B08B 1/002* (2013.01); *B25G 1/06* (2013.01)

(58) Field of Classification Search

CPC ..... F28G 1/02; A46B 3/02; A46B 5/0012; A46B 5/0058; A46B 9/025; B08B 1/002; B25G 1/06

See application file for complete search history.

(56) References Cited

U.S. PATENT DOCUMENTS

| | | | | |
|---|---|---|---|---|
| 4,493,126 | A * | 1/1985 | Uy | A46D 1/00 15/186 |
| 4,734,953 | A * | 4/1988 | Dodson | A46B 17/04 15/106 |
| 5,592,711 | A * | 1/1997 | Maier | A46B 7/023 15/106 |
| 2005/0273962 | A1* | 12/2005 | Dillon | A46B 9/10 15/169 |
| 2014/0345073 | A1 | 11/2014 | Marichi Rodriguez | |
| 2017/0172288 | A1* | 6/2017 | Bart | A46B 7/026 |

* cited by examiner

*Primary Examiner* — Shay Karls
(74) *Attorney, Agent, or Firm* — William C. West

(57) ABSTRACT

The present invention provides a coil brush having one or more brush heads with any brush head parallel to any other. The brush heads may have a head base, a bristle slide or guide, and bundles or groups of straight and/or angled bristles, which may be interspersed in different arrangements in a head base of the head brush head, allowing for a variety of brushing planes. The coil brush may further comprise a rear mount handle or a detachable handle that allow the user to adjust the position of the brush to better access and clean coils in hard to reach places. The bristle slide allows the user to control the stiffness of the bundles of bristles by controlling the spreading of the bristles. This invention allows the brushing of coils in heating ventilation and air conditioning equipment at a variety of angles from a variety of coil access points.

15 Claims, 10 Drawing Sheets

COIL BRUSH

FIELD OF THE INVENTION

This invention relates in general to brush for cleaning the coils of a heating, ventilating, and air conditioning system (HVAC) and more specifically to an coil brush to clean the evaporator coils of the system.

BACKGROUND OF THE INVENTION

Keeping evaporator coils clean greatly enhances the efficiency of and Air Conditioning System. Cleaning the coils without first removing them from the a/c system is difficult due to the geometry of the coil as well as proximity of the coil within the system. Evaporator coils have as many as four individual, flat surfaced coil sections that converge to form an "A", "N", or "M" shaped configuration. The convergent points leave very little room for access using any cleaning device. The coil fins themselves may be arranged in a parallel, adjacent pattern and are evenly spaced at 12 to 18 fins per inch. Debris settles on the surface of the coils as well as between these individual coil fins. With the close spacing of the fins it is very difficult to remove debris from between them. There are no comb type brushes specifically designed for cleaning evaporator coils. Various type brushes designed for other uses are generally used, i.e. cat hair brush, pot brush, wire welding brush. These do not address the issues of limited access, coil geometry, or limited space.

Currently used devices do not have the proper configuration to access the complete surface of the coil. They are either too big to fit in tight spaces or have insufficient properties to remove debris from the coil surface as well as between the coil fins.

SUMMARY OF THE INVENTION

The present invention provides a coil brush comprising bundles or groups of bristles anchored in a head base of a brush head. In one embodiment the bundles of bristles may be aligned in the brush head and the bundles of bristles may be straight and/or bent bristles. The coil brush may be used by wrapping a user's hand around a head base of the brush head or an articulating handle that may be attached to the head base of the brush head. The articulating handle allows the coils to be cleaned from a variety of angles and accessed from a variety of access points. The individually spaced bristle bundles of the coil brush allow debris from between the fins of the coil as well as the surface of the coil to be accessed. An adjustable slide allows the user to adjust the stiffness of the bundles of bristles. The brush head may have a generally plate like head base with each of the bristle within the bundles of bristles having a mid portion extending from the head base, and the mid portion located between a base portion of the bristle that is anchored in the head base and a forward portion of the bristle having a business end. Another embodiment of the present invention may include a first head base of bundles of bristles at a first bristle angle mounted on second head base with bundles of bristles at a second bristle angle. The first head base may have a rail that slides in a track on the second head base allowing the business ends of the first head base to slide forward of the business ends of the bundles of bristles of the second head base, or vice versa, to form the brushing plane. In yet another embodiment of the present invention may feature bristle bundles at the second bristle angle mounted in a sliding mount, also called a slide mount, that slides on the bristle bundles at the first bristle angle allowing the business end of the bristle bundles at the second angle to move forward of the business end of the bristle bundles at the first bristle angle. The bundles of bristles at the first bristle angle and the bundles of bristles at the second angle each may be through a slide forward of the sliding mount to maintain the stiffness of the respective bundles. A still yet another embodiment of the present invention, the dual slide head coil brush, comprises bristle bundles at the first bristle angle mounted in a first slide head, bristle bundles at the second bristle angle mounted in a second slide head, a master slide head, a slide forward of the master slide on each of the bristle bundles at the first bristle angle and the bristle bundles at the second bristle angle, and a handle attached to the master slide. While the bristle bundles may be bundles of straight bristles, or bundles of bent bristles that are bent at some bristle angle, there may be bundles of hook shaped bristles that feature bristles having a hooked shaped forward portion. The simple and thin head base profile, the ability to employ a variety of different heads having bundles of bristles that have straight bristles, bristles at diverse angles, and hook shaped bristles, and the variety of articulating rear mount and top mount handles allow access to the converging points of many different coil configurations and allow accessing the coil surfaces through restrictive points of entry.

Among the advantages of the present invention is the ability to perform with greater ease and efficiency the brushing or cleaning of the coils in hard to reach areas where a flexible cleaning tool is beneficial.

These and other features and advantages of the coil brush according to this invention may be discussed below with respect to various illustrative embodiments of the invention as defined by the claims.

DETAILED DESCRIPTION OF THE INVENTION

In the following detailed description of the numerous embodiments of the present invention, reference is made to the accompanying figures that are part of it. It is understood that other methods could be used and that structural changes may be made without departing from the scope of the present invention.

Figure 1:
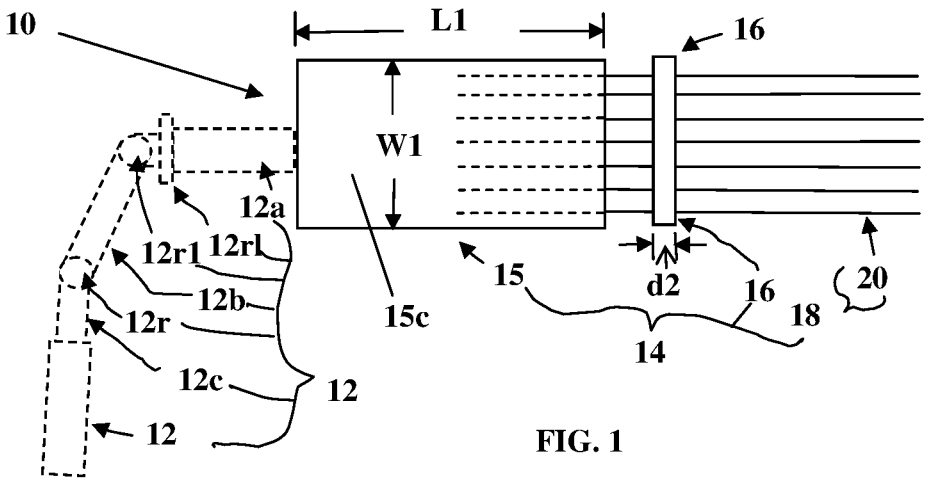
FIG. 1 shows a top view of one embodiment of the present invention with an arrangement of bristle bundles with each bundle having one bristle and an optional handle rotated to show a side view.
Figure 2:
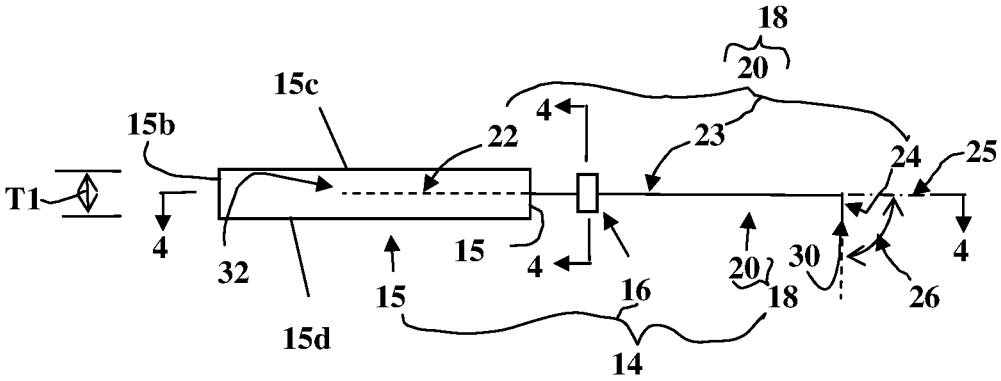
FIG. 2 shows a side view of the head base of the brush head and the bristle slide of the present invention with a forward portion of the bristle bent at a bristle angle.
Figure 3:
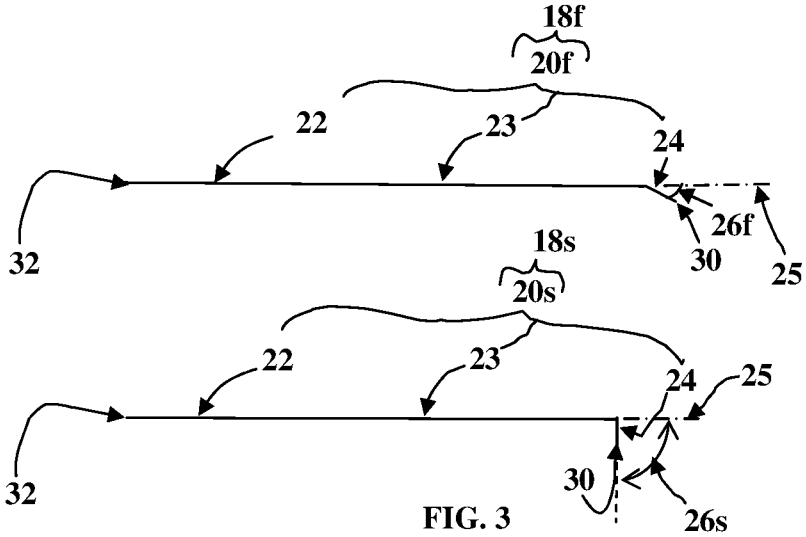
FIG. 3 a view of a first bristle bundle with the forward portion of a first bristle bent at a first bristle angle, and a second bristle bundle with the forward portion of a second bristle bent at a second bristle angle.
Figure 4:
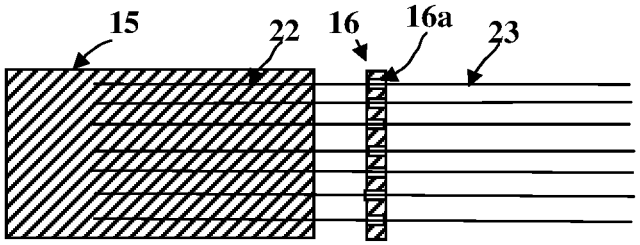
FIG. 4 shows a sectional view along line 4-4 of FIG. 2
Figure 5:
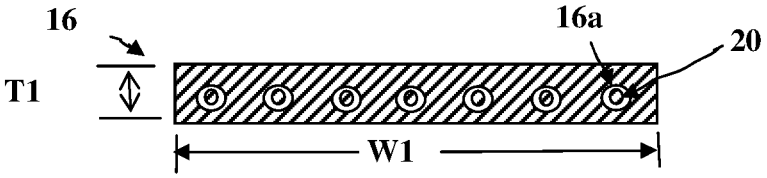
FIG. 5 shows a sectional view along line 5-5 of FIG. 2
Figure 6A:
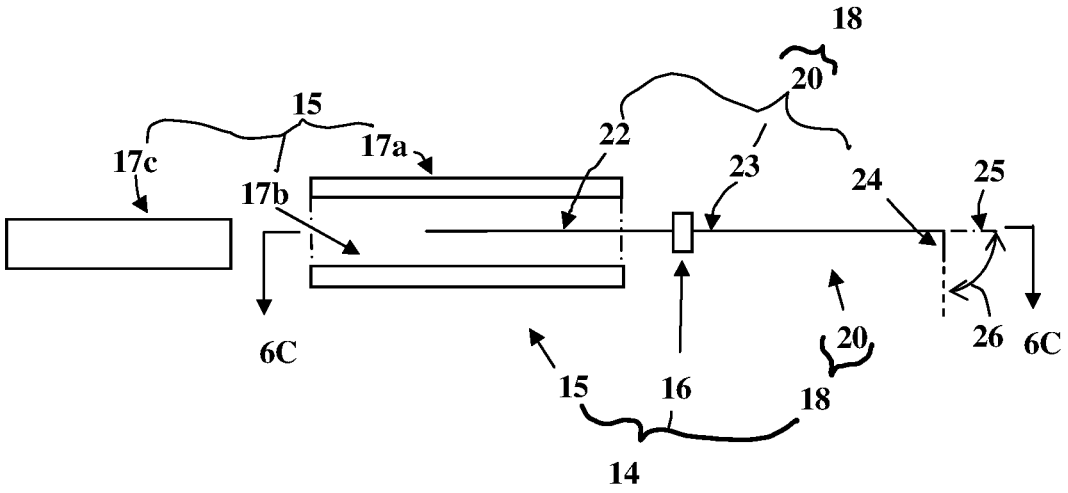
FIG. 6A shows a side view of a head base first portion and a head base second portion of the head base of the one embodiment of the presentation, the coil brush, with a base portion of bristles between the head base first portion and the head base second portion.
Figure 6B:
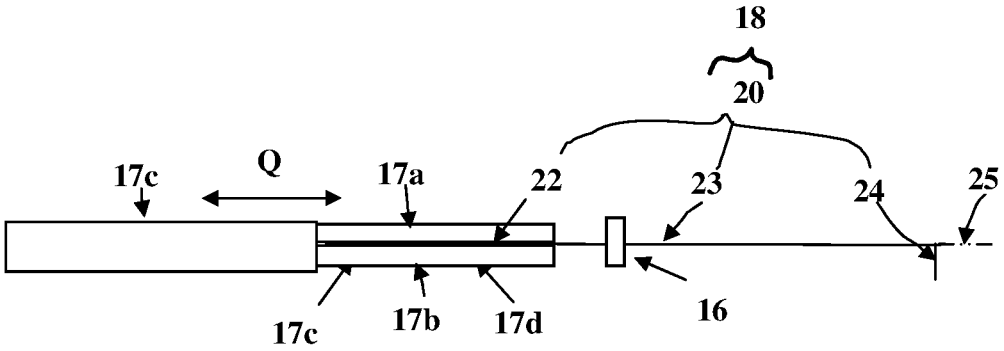
FIG. 6B shows a side view of the head base of the brush head of one embodiment of the presentation with the forward portion bent, and a mid portion and the base portion of the bristles aligned along the mid base axis of the bristles.
Figure 6C:
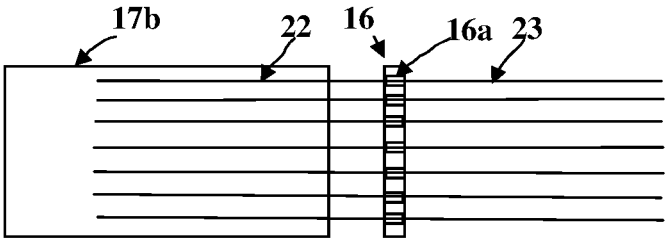
FIG. 6C shows a sectional view along line 6C-6C of FIG. 6B.

FIG. 1 depicts an illustration of one embodiment of the present invention, a coil brush 10. The coil brush 10 may include an optional handle, such as a rear mount handle 12, a brush head 14, and a bristle slide 16, also called a slide. The brush head 14 may be used to hold the coil brush 10 without the rear mount handle 12. The brush head 14 comprises a head base 15 having a head base forward end 15*a* and a head base rearward end 15*b*, a top base side 15*c*, and a bottom base side 15*d*, and one or more bristle bundles 18, with each bristle bundle 18 having at one or more bristles 20. Each of the one or more bristles 20 may comprise a base portion 22, a mid portion 23 and a forward portion 24 with the mid portion 23 located between the base portion 22 and the forward portion 24. Referring to FIG. 2, the mid portion 23 is an extension of the base portion 22 along a mid base axis 25. The forward portion 24 may be bent to form a bristle angle 26 with the mid base axis 25. Referring to FIG. 3, a coil brush 10 may also have bristle bundles 18 at different bristle angles 26, such as a first bristle bundle 18*f* having a first bristle 20*f* at a first bristle angle 26*f* and second bristle bundle 18*s* having a second bristle 20*s* at a second bristle angle 26*s*. Where the bristle angle is 0 degrees, the base portion 22, the mid portion 23, and the forward portion 24 will form a straight bristle (not shown). Looking to the second bristle bundle 18*s*, the second bristle angle 26*s* is about −90 degrees. Where the bristle angle, such as the second bristle angle 26*s* is between −90 and −270 degrees, a business end 30 (a distal end) of the second bristle 16*s* may point back toward the head base end 32 that is located in the head base 15 (i.e., the forward portion 24 folds toward the mid portion 23), thereby forming a hook or a hook shaped bristle (not shown). Referring to FIG. 4, a sectional view along line 4-4 of FIG. 2, the bristles 20 may be disposed with the mid portion 23 of the bristles 20 parallel to each other. Looking again to FIGS. 2 and 3, the bristle 20, first bristles 20*f* and second bristle, each have the business end 0 and a head base end 32, with the business ends 30 (the distal ends) of the bristles 20 forming the distal end of coil brush 10. The business ends 30 form the brushing plane that is a brush contact area with a targeted cleaning area, such as the coils of a heat, ventilating, and air conditioning (HVAC) system. The base portion 22 with the head base end 32 of the bristle 20 is anchored in the head base 15 of the coil brush 10. The head base forward end 15*a* maybe be drilled, and the base portion 22 of bristle 20 inserted in the head base 15 and held in place by a suitable adhesive, such as glue. Looking to FIG. 4, a sectional view along line 4-4 of FIG. 2, the bristle bundles 18 are placed in apertures 16*a* of the brush slide 16. Referring to FIG. 5, an exploded view sectional view along line 5-5 of FIG. 2, the brush slide 16 is shown with the bristles 20 disposed through the bristle apertures 16*a* of the brush slide 16, and the bristle apertures 16*a* aligned in a straight line. Referring to FIG. 6A, the head base 15 may comprise head base first portion 17*a* and a head base second portion 17*b*, and the bristle bundles 18 of the bristles 20 placed between a head base first portion 17*a* and a head base second portion 17*b*. The bristles 20 held in place by a suitable adhesive, such as glue, and/or a pressure of the head base first portion 17*a* against the bristles 20 and the head base second portion 17*b*. The head base first portion 17*a* and the head base second portion 17*b* may be held to each other by a screw 17*c*, a rivet 17*d*, an adhesive (not shown) with the bristle bundles 18 of bristles 20 inserted there between, or as shown in FIG. 6B, the head base first portion 17*a* and the head base second portion 17*b* may be wrapped by a head base covering 17*c* that slides over the head base 15 in wrap direction Q. Referring to FIG. 6C, a sectional view along line 6C-6C of FIG. 6A, the bristle bundles 18 are disposed through the bristle apertures 16*a* of the slide 16 and between the head base second portion 17*b* and the head base first portion 17*a* of FIG. 6B.

Figure 7:
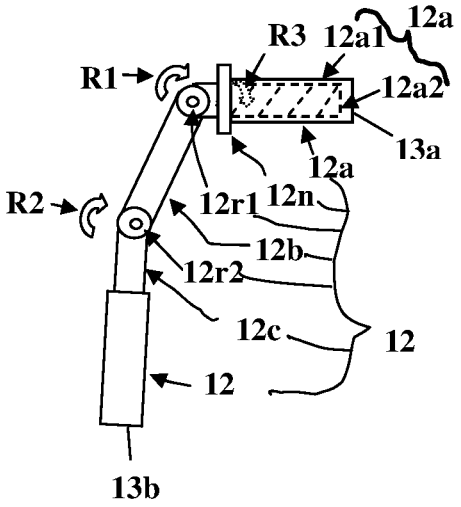
FIG. 7 shows a side view of an optional handle of FIG. 1.
Figure 8:
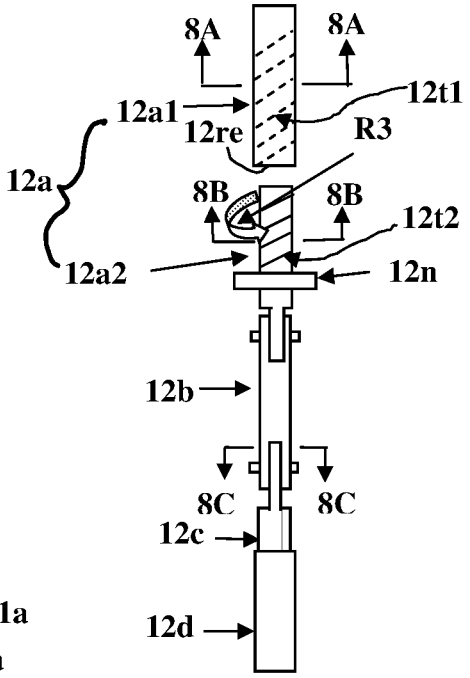
FIG. 8 shows a top view of the handle with the handle extended in a straight line.
Figure 9:
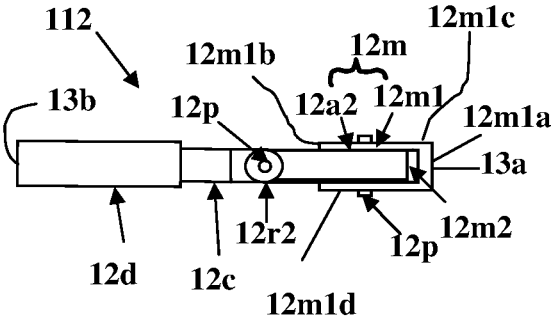
FIG. 9 shows a side view of second rear mount handle.
Figure 9:
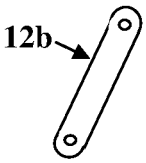
Figure 8A:
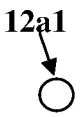
FIG. 8A shows a sectional view along line 8A-8A of FIG. 8.
Figure 8B:
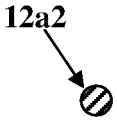
FIG. 8B shows a sectional view along line 8B-8B of FIG. 8.
Figure 8C:
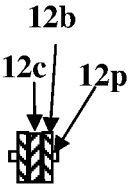
FIG. 8C shows a sectional view along line 8C-8C of FIG. 8.

Referring to FIGS. 1 and 7, the optional handle, such as the rear mount handle 12, may have a first handle portion 12*a*, first rotary handle joint 12*r*1, a second handle portion 12*b*, a second rotary handle joint 12*r*2, and a third handle portion 12*c*. The first rotary handle joint 12*r*1 and the second rotary handle joint 12*r*2 rotate allowing the handle to be disposed folded in first direction R1 and second direction R2. The first handle portion 12*a* may comprise a internally threaded cylinder portion 12*a*1 and an external threaded plug portion 12*a*2 with a threaded nut 12*n* on the plug portion 12*a*2 allowing the plug portion 12*a*2 to be fixed relative to the cylinder portion 12*a*1 once the plug portion 12*a*2 is rotating in path R3 to a desired position allowing the business end 30 of the bristles 20 to clean the intended target, such as coils of a heating ventilating and air conditioning (HVAC) unit. By rotating the plug portion 12*a*2, the second handle portion 12*b* and the third handle portion 12*c* may rotating in first direction R1 about the cylinder portion 12*a*1 that is fixed to the head base 15 of the brush head 14. Referring to FIG. 8A, a sectional view along line 8A-8A of FIG. 8 is shown. Referring to FIG. 8B, a sectional view along of the plug portion 12*a*2 along line 8B-8B of FIG. 8 is shown. Referring to FIG. 8C, a section view along line 8C-8C of FIG. 8 is shown illustrating the second handle portion 12*b* connected to the third handle portion 12*c* using a pin 12*p*. The plug portion 12*a*2 may have external threads 12*t*2 configured to fit internal treads 12*t*1 of the cylinder portion 12*a*1. The plug portion 12*a*2 may be screwed into or out of the cylinder portion 12*a*1 to achieve the desired position and then the locked by turning the threaded nut 12*n*, located on the plug portion 12*a*2, to seal against the rim edge 12*re* of the cylinder portion 12*al*. The plug portion 12*a*2 allows the rear mount handle 12 to be rotated in the clockwise and counter clockwise direction around path R3 and locked in position with the threaded nut 12*n*. The rear mount handle 12 will have a handle first end 13*a* and a handle near end 13*b*, the handle first end 13*a* connected the head base rearward end 15*b*. Referring to FIG. 9 a second rear mount handle 112 is shown. The second handle portion 12*b* of FIG. 8 is removed and third handle portion 12*c* with the hand grip 12*d* connected at the second rotary handle joint 12*r*2 to the plug portion 12*a*2 using the pin 12*p*. The cylinder portion 12*a*1 of FIG. 8 may be replaced by a plate 12*m* with the plate 12*m* having a plate like slot 12*m*2 cut in a plate rearward end 12*m*1*b* as shown in FIG. 9. The plate 12*m* may be generally rectangular with a plate forward end 12*m*1*a*, a plate rearward end 12*m*1*b*, a plate top, side 12*m*1*c*, and a plate bottom side 12*m*1*d*. The plug portion 12*a*2 may rotate about a plate pin 12*p*1 that is placed through the plate 12*m* and the plug portion 12*a*2. The plug portion 12*a*2 rotates about the plate pin 12*p*1 in a plane generally perpendicular to the plane of rotation of the third handle portion 12*c* that rotates about the pin 12*p* of second rotary handle joint 12*r*2. The plate pin 12*p*1 is inserted through the plate top side 12*m*1*c*, through the plug portion 12*a*2, and then through the plate bottom side 12*m*1*d*. The second rear mount handle 112 may be connected to the head base 15 by attaching a plate forward end 12*m*1*a* of the second rear mount handle 112 to the head base rearward end 15*b* of the head base 15.

Figure 10:
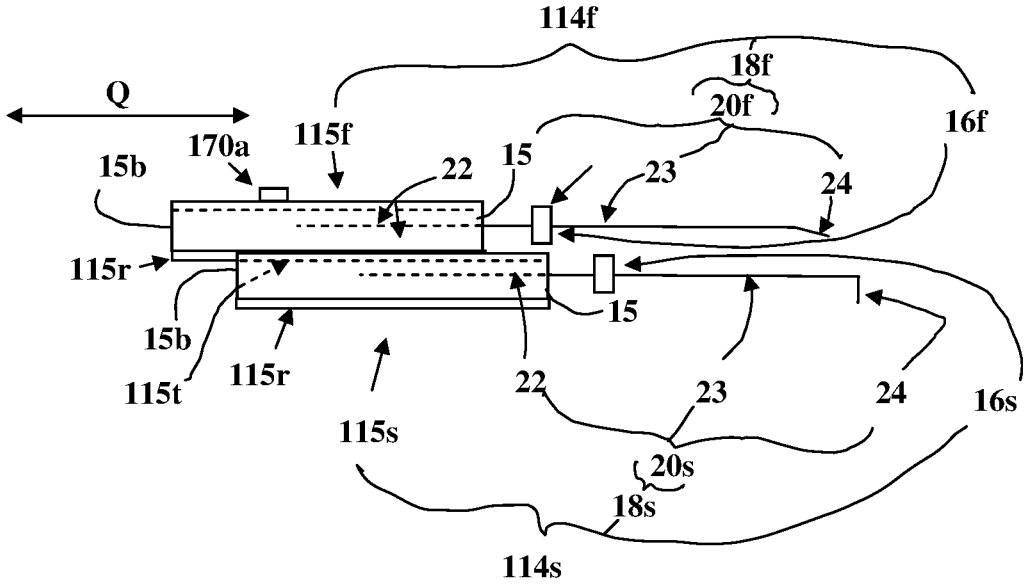
FIG. 10 shows of a side view of another embodiment of the coil brush.
Figure 11:
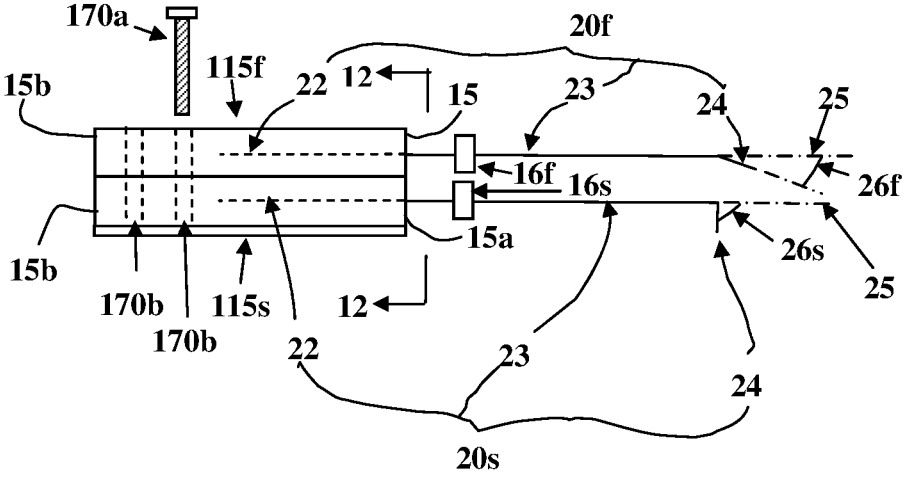
FIG. 11 shows a side view of the another embodiment of the coil brush with a first head base and a second head base aligned.
Figure 12:
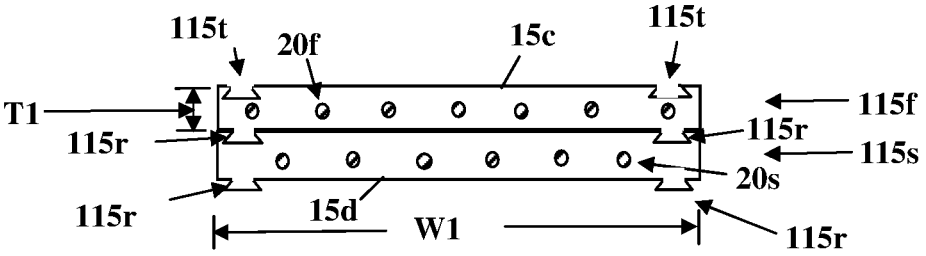
FIG. 12 shows a sectional view of the along line 12-12 of FIG. 11.

Looking to FIG. 10, another embodiment of the present invention, a dual head coil brush 110, is shown. The dual head coil brush 110 is comprised essentially of two copies of the one embedment of the present invention with a first copy of the coil brush 10 stacked on a second copy of the coil brush 10. One or more rails 115*r* are added to a head top side 15*c* of the head base 15 of the brush head 14 of the first copy of the coil brush 10 forming a first head base 115*f* of a first brush head 114*f*. One or more tracks 115*t* are added to a head top side 15*c* of the second head base 115*s* forming a second head base 115*s*. The head base 15 of the brush head 14 of the first copy of the coil brush 10 forms a first head base 115*f* of a first brush head 114*f*. At least one rail 115*r* is added to a head base 15 of a brush head 14 of the second copy of the coil brush 10 forming a second head base 115*s* of a second brush head 114*s*. Referring to FIG. 11, the first head base 115*f* and the second head base 115*s* may be locked in position by a screw 170*a* inserted in threaded apertures 170*b* on the first head base 115*f* and the second head base 115*s*. Referring to FIG. 12, a sectional view along line 12-12 for FIG. 11, the first head base 115*f* and the second head base 115*s* may have the one or more tracks 115*t* on one side, such as the head top side 15*c*, the one track 115*t* disposed parallel to any other track 115*t* on the head top side 15*c*. Also, first head base 115*f* and the second head base 115*s* may have one or more rails 115*r* on the other side, such as a head bottom side 15*c*, the one or more rails 115*r* parallel to any other rail on the bottom side 115*d*. The one or more rails 115*r* on the first head base 115*f* are disposed configured to fit in the one of more tracks 115*t* of the second head base 115*s* or visa versa. Although two head bases, a first head base 115*f* and a second head base 115*s*, are shown in FIGS. 10-12, additional head bases may be stacked one upon the other in a like manner. The second rear mount handle 112, may be connected to the head base rearward end 15*b* of the first head base 115*f* by attaching the plate forward end 12*m*1*a* of the plate 12*m* to the head base rearward end 15*b* of the first head base 115*f*.

Figure 13:
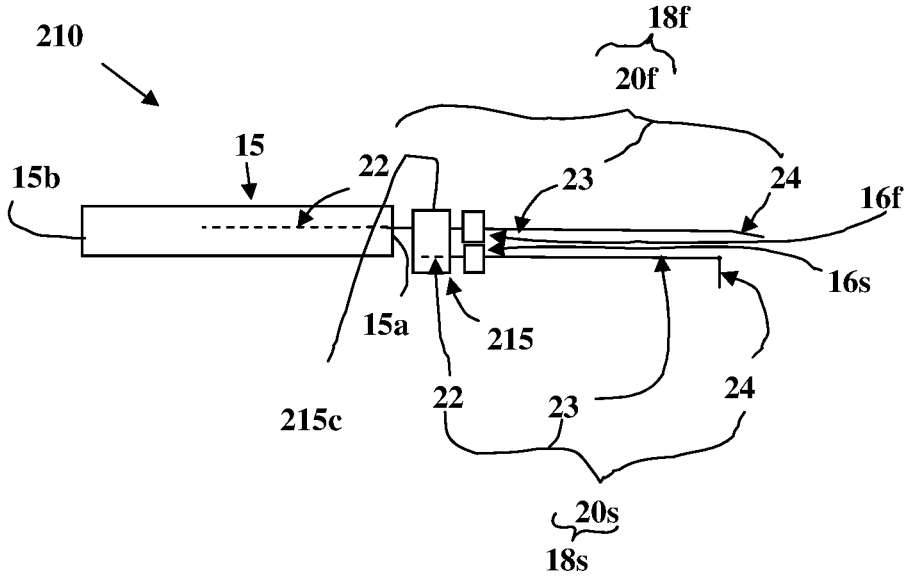
FIG. 13 shows a side view of yet another embodiment of the coil brush.
Figure 14:
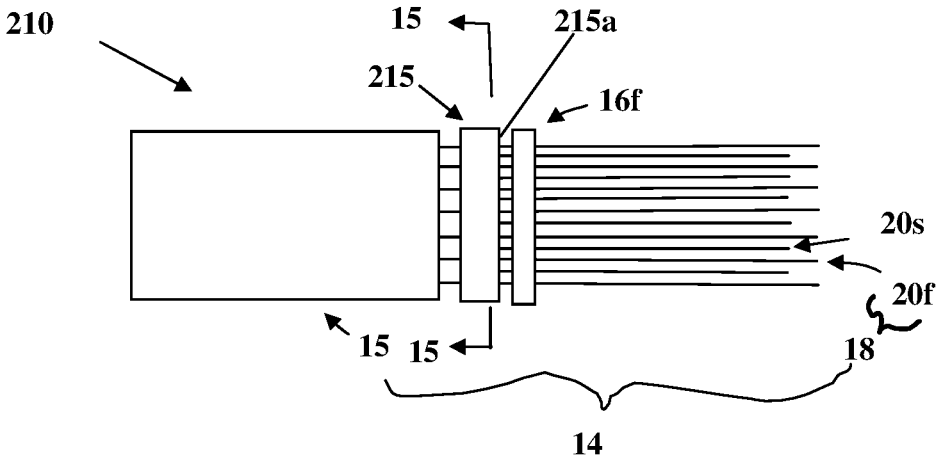
FIG. 14 shows a top view of the yet another embodiment of the coil brush.
Figure 15:
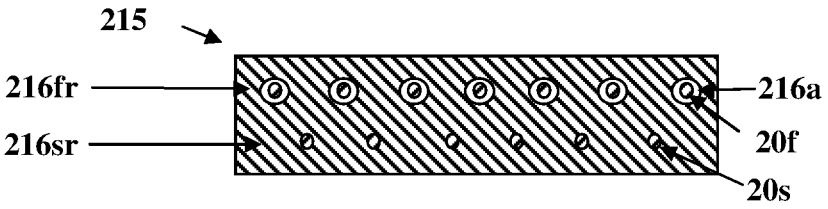
FIG. 15 shows a sectional view along line 15-15 of FIG. 14.
Figure 16:
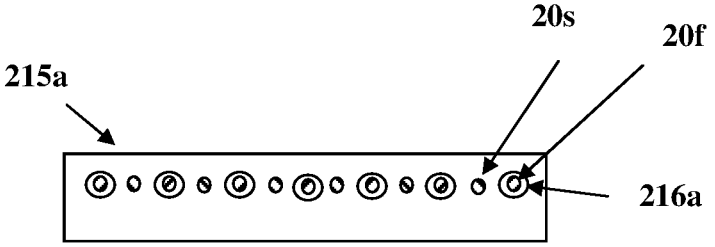
FIG. 16 shows a frontal view of the slide mount of the yet another embodiment with the bristle bundles of the slide mount with the bristles aligned in a single row.

Referring to FIG. 13, a yet another embodiment of the present invention, a slide mount coil brush 210 is shown. The slide mount coil brush 210 has the second bristle bundles 18*s* as shown in FIG. 3 at the second bristle angle 26*s* mounted in a slide mount 215 that slides on the first bristle bundles 18*f* as shown in FIG. 3 at the first bristle angle 26*f*. The first bristle bundles 18*f* are mounted in the head base 15, allowing the business end 30 of the second bristle bundles 18*s* at the second bristle angle 26*s* to move forward of the business end 30 of the first bristle bundles 18*f* at the first bristle angle 26*f*. The first bristles 20*f* at the first bristle angle 26*f* may have the first slide 16*f* like the slide 16 of FIGS. 1,2 and 4 forward of the slide mount 215 to maintain the stiffness and separation of the first bristles 20*f*, and the bundles of bristles at the second bristle angle 26*s* may have a second slide 16*s* like the slide 16 of FIGS. 1,2 and 4 forward of the slide mount 215 to maintain the stiffness and separation of the second bristles 20*s*, but the second slide 16*s* may be deleted when maintaining the stiffness and the separation are not required. The base portions 22 of the second bristles 20*s* may be mounted in the slide mount 215 is a manner similar to that of the base portion 22 of the bristle 20 mounted in the head base 15 of the one embodiment shown in FIG. 2. The second rear mount handle 112 of FIG. 9 may be connected to the slide mount 215 shown in FIG. 13 by attaching the plate bottom side 12*m*1*d* of the plate 12*m* in FIG. 9 to a slide mount top side 215*c* of FIG. 13 with a screw, a bolt, or an adhesive, such as glue. FIG. 14 shows a top view of the yet another embodiment of the coil brush and FIG. 15 shows a sectional view along line 15-15 of FIG. 14. FIG. 16 shows a frontal view of the slide mount of the yet another embodiment with the bristle bundles of the slide mount with the bristles aligned in a single row.

Figure 17:
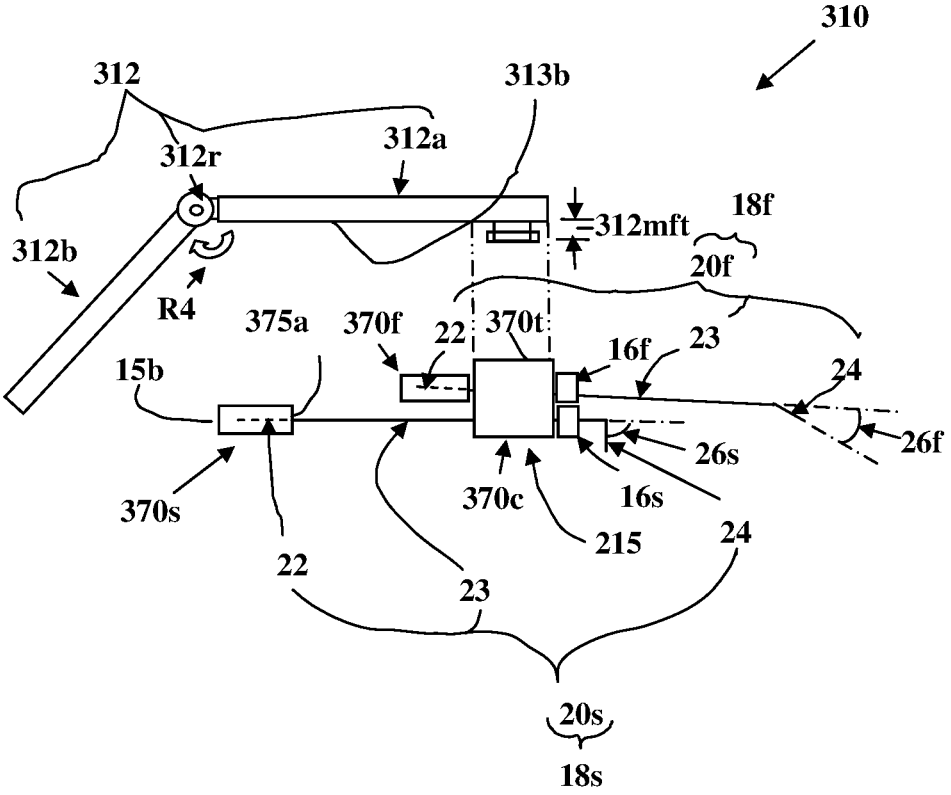
FIG. 17 shows a side view of still yet another embodiment of the present invention.
Figure 18:
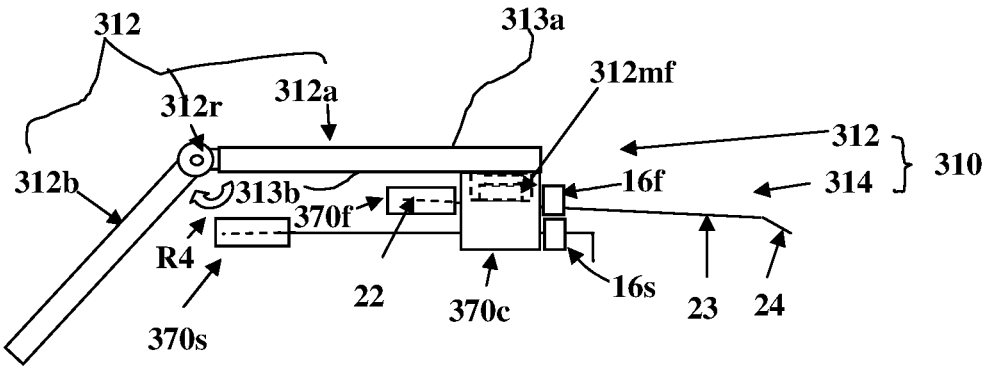
FIG. 18 shows another side view of the still yet another embodiment of the present invention with a removable handle attached.
Figure 19:
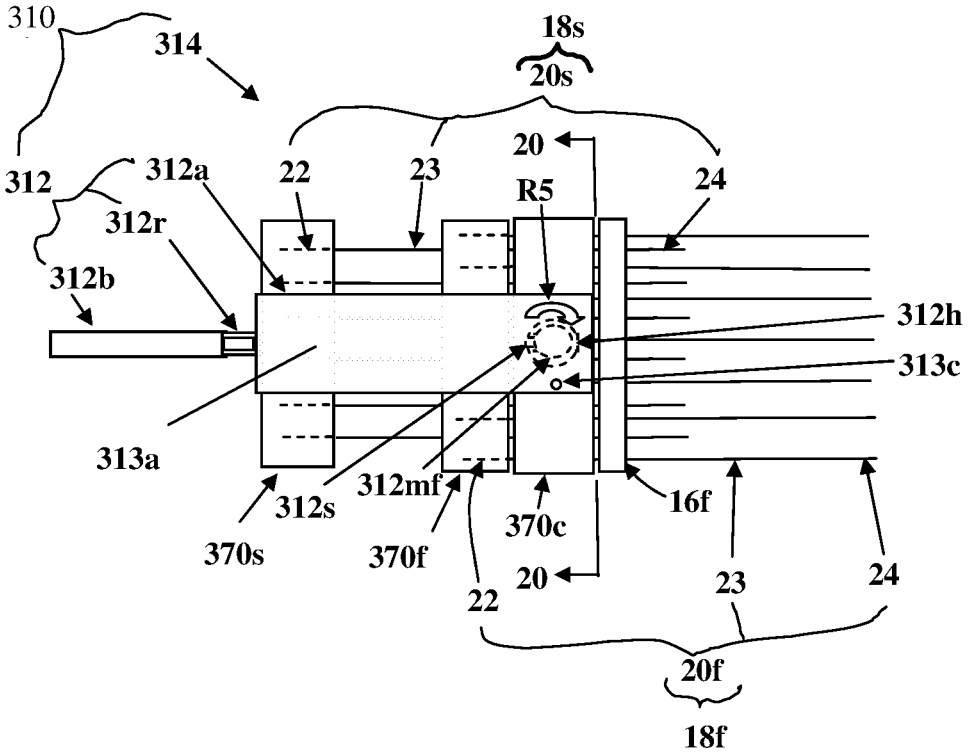
FIG. 19 shows a top view of the still yet another embodiment of the present invention with the removable handle attached.
Figure 20:
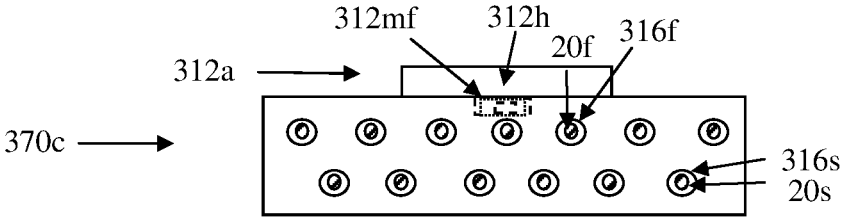
FIG. 20 shows a sectional view along line 20-20 of FIG. 19.
Figure 21:
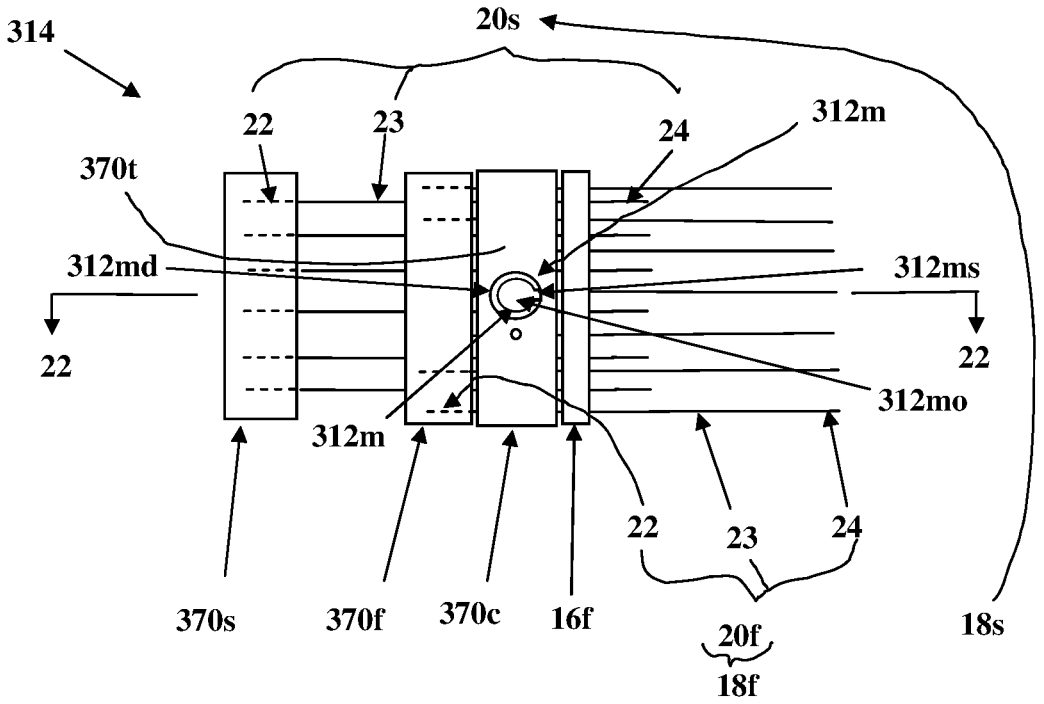
FIG. 21 shows a top view of the still yet another embodiment of the present invention.
Figure 22:
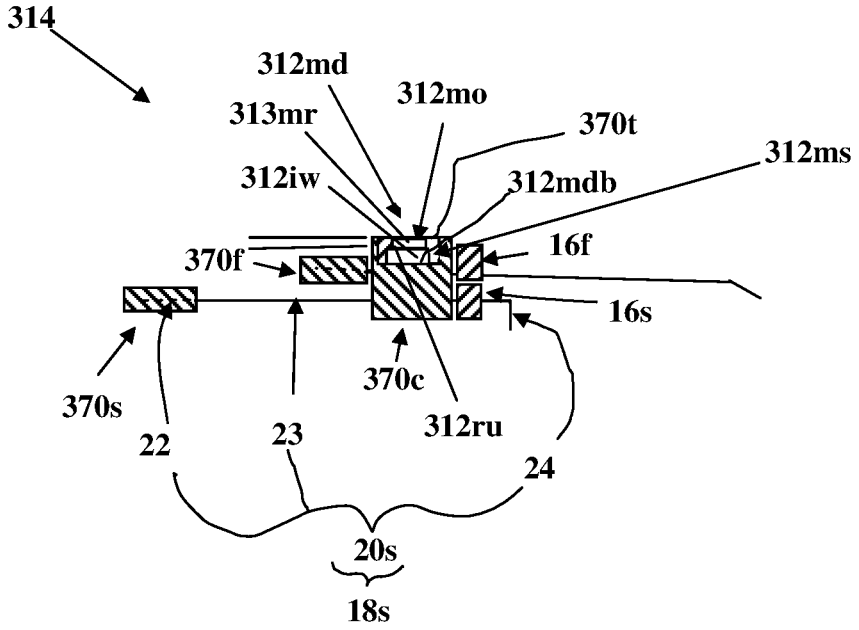
FIG. 22 shows a sectional view along line 22-22 of FIG. 21.
Figure 23:
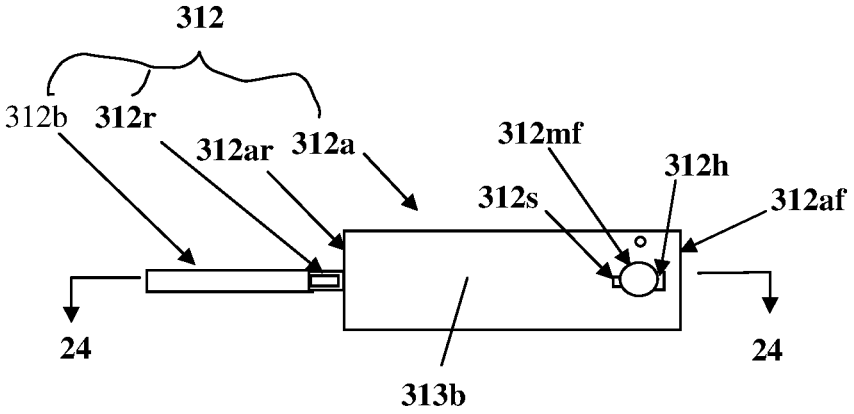
FIG. 23 shows bottom side view of the removable handle.
Figure 24:
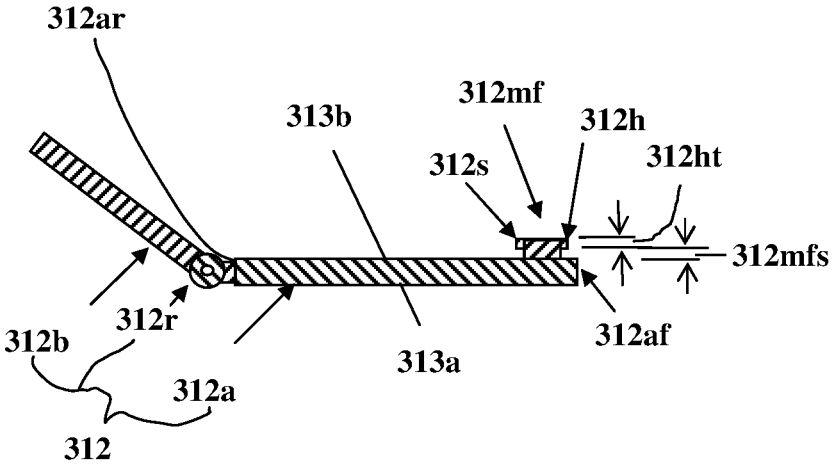
FIG. 24 shows a sectional view along line 24-24 of FIG. 23.

Referring to FIG. 17, a side view of a still yet another embodiment of the present invention, a dual slide head coil brush 310, is illustrated. FIG. 18 shows another side view of the still yet another embodiment of the present invention with a removable handle attached. FIG. 19 shows a top view of the still yet another embodiment of the present invention with the removable handle attached. FIG. 20 shows a sectional view along line 20-20 of FIG. 19. The dual slide head coil brush 310 comprises: the first bristle bundles 18*f* with the first bristles 20*f* at the first bristle angle 26*f* mounted in a first slide head 370*f*; the second bristle bundles 18*s* at the second bristle angle 26*s* mounted in a second slide head 370*s*; a master slide 370*c*; a first slide 16*f* forward of the master slide 370*c* on each of the first bristle bundles 18*f* at the first bristle angle 26*f*; and the second slide 16*s* on the second bristle bundles 18*s* at the second bristle angle 26*s*; and a removable handle 312. The removable handle 312 has a removable first portion 312*a* that is attached the master slide 370*c* by inserting a mount foot 312*mf* into a mount depression 312*md* located on an upper side 370*t* of the master slide 370*c*. Referring to FIG. 21 and FIG. 22, the mount depression 312*md* may have a cylindrical opening 312*co* in a mount rim 312*mr* that has a mount slot 312*ms*, and referring to FIGS. 23 and 24, the mount slot 312*ms* is configured to allow a stub 312*s* positioned opposite a hold 312*h* on the mount foot 312*mf* to be inserted in the mount slot 312*ms*. To attach the removable handle 312 to the master slide 370*c*, the hold 312*h* is first placed in the cylindrical opening 312*co* of the mount depression 312*md* under the mount rim 312*mr* with the stub 312*s* aligned and inserted through the mount slot 312*ms*, and then the removable handle 312 rotated 180 degrees, placing the hold 312*h* beneath a portion of the mount rim 312*mr* adjacent to the mount slot 312*ms*, holding the removable handle 312 to the master slide 370*c*. The handle is detached by reversing the attachment procedure. The mount depression 312*md* may have a mount depression depth as measured form the upper surface 370*t* of the master slide 370*c* to the depression bottom 312*mdb* at least 0.5 to 0.75 inches, with the mount rim 312*mr* extending 0.2 to 0.4 inches inward from the inner wall 312*iw* of the mount depression 312*md* and having a rim thickness at the mount opening 312*mo* as measured from the upper surface 370*t* to the rim underside 312*ru*, the rim thickness configured and sized to be 0.02 inches less than a mount foot shaft thickness 312*mfst* that is as measured from the hold 312*h* to a bottom side 313*b* of the removable handle first portion 312*a*. The hold 312*h* is sized to fit under the mount rim 312*mr* and is 3 times a width of the mount slot 312*ms* as measured around the inner wall 312*iw* of the mount depression 312*md* parallel to the mount depression bottom 312*mdb*. The mount slot 312*ms* may be 0.125 to 0.25 inches as measured parallel to the mount depression bottom 312*mdb*. The first bristle bundles 18*f* of the first bristles 20*f* may be anchored in the first slide head 370*f* and the second bristle bundles 18*s* of the second bristles 20*s* may be anchored in the second slide head 370*s* using any one of the methods discussed for the head base 15 of the one embodiment of the present invention and shown in FIGS. 2, 3, 4, 6A, 6B, and 6C. The second rear mount handle 112 of FIG. 9 may also be attached to the dual slide head coil brush 310 shown in FIG. 17. The plate bottom side 12*m*1*d* of the second rear mount handle 112 of FIG. 9 may also be attached to the upper side 370*t* of the master slide 370*c* of the dual slide head coil brush 310 shown in FIG. 17 by using an adhesive, screws, or a bolt.

Although the bristles 20 shown in FIG. 1 contain only one bristle 20, each bristle bundle 18 may consist of more than one bristle 20. Likewise the first bristle bundles 18*f* each may have more than one first bristle 20*f*, and the second bristle bundles 18*s* each may have more than one second bristle 20*s*. Although the bristles 20 shown in FIG. 2 are bent, the one or more bristle bundles 18 may consist of bristles 20 that are straight as shown in FIG. 4 where the base portion 22, the mid portion 23 and the forward portion 24 may be aligned along the mid base axis 25, or the bristles 20 each may be bent relative to the mid base axis 25 at a bristle angle 26, the bristle angle 26 ranging between and including 115° and −115° as measured from the mid base axis 25. Likewise the first bristle bundles 18*f* and the second bristle bundles 18*s* may have more than one first bristle 20*f* and more than one second bristle 20*s*, respectively, for each of the another embodiment, the yet another embodiment, and the still yet another embodiment of present invention.

The head base 15; the first head base 115*f* and the second head base 115*s*; the slide heads, such as the first slide head 370*f*; the master slide 370*c*, the bristle slides, such as the first slide 16*f*; and the handle, such as the rear mount handle 12, may be manufactured of any suitable material known in the art, for example, polymeric materials or copolymers, polypropylene, PBT, nylon, metal, wood, fiberglass, etc., and combinations thereof. The head base 15; the first head base 115*f* and second head base 115*s*; the slide heads, such as the first slide head 370*f*; the master slide 370*c*, and the slides, such as the first slide 16*f* may be rectangular shaped with the bristle bundles 18 disposed parallel to each other. The head base 15 may be used to grip and hold the coil brush 10 or an exemplary embodiment of the invention, the coil brush 10 with the rear mount handle 12, may have all the component parts of the coil brush 10 plus the rear mount handle 12 extended from the head base rearward end 15*b* of the coil brush 10 to form the coil brush 10 with the rear mount handle 12.

The brush head 14 has a head base 15 with a head base forward end 15*a* and a head base rearward end 15*b*, with the bristle bundles 18 inserted in the head base forward end 15*a* using any suitable technique known, for example: adhesives, mechanical fasteners, wires, thermal or chemical welding, pressure, etc. The arrangement of the bristle insertion may take the any suitable form, such as a parallelogram with the base portion 22 and the mid portion 23 of the bristles 20 in the bristle bundles 18 parallel to any of the base portion 22 and mid portion 23 of the other bristle bundles 18. An arrangement of the bristles 20 inserted in the base portion 15 may be in rows, such as the first row 216*fr* for the first bristles 20*f* and the second row 216*sr* of second bristles 20*s*, as illustrated in FIG. 15.

In the head base 15 of the brush head 14 where the bristle bundles 18 of bristles 20 are inserted, the bristle bundles 18 may have comprise bristles 20 of different sizes, shapes and designs of placement as well as different characteristics that modify the surface of the brushing plane or bristle surface, providing additional surfaces of the brushing plane.

It is understood that elements with the same numeral and alphabetical identifier are like elements.

Having sufficiently described the invention in the preceding paragraphs, what is contained in the following claims is what is claimed as intellectual property.

What is claimed is:

1. A coil brush comprising a brush head and a slide mount; the brush head having a head base and one or more first bristle bundles of first bristles; the slide mount having one or more slide apertures; the one or more slide apertures for the first bristle bundles of the first bristles disposed there through; and the slide mount configured to slide along the first bristles of the first bristle bundles; and the head base further comprising one or more tracks and one or more rails configured to mount the head base to another head base.

2. The coil brush of claim 1 wherein the first bristles each have a base portion, a mid portion, and a forward portion; the mid portion located between the base portion and the forward portion; and the mid portion having a mid base axis; the forward portion of each of the first bristles having a first bristle angle with the mid base axis.

3. The coil brush of claim 2 wherein the first bristle angle is between 115° and −115°.

4. The coil brush of claim 2 wherein the first bristle angle is −90 degrees.

5. The coil brush of claim 2 wherein the first bristle angle is between −90 and −270 degrees forming a hook.

6. A coil brush comprising a head base and a slide mount; the brush head having a head base and one or more first bristle bundles of first bristles; the slide mount having one or more slide apertures; the one or more slide apertures for the first bristle bundles of the first bristles disposed there through; and the slide mount configured to slide along the first bristles of the first bristle bundles; the coil brush further comprising a first slide and a second slide; the slide mount having one or more second bristle bundles of second bristles; the first slide and the second slide having one or more bristle apertures; the first bristle bundles of the first bristles inserted through the bristle apertures of the first slide and through the slide apertures of the slide mount and through a head base forward end of the head base into the head base; the second bristle bundles of the second bristles inserted through the bristle apertures of the second slide and through a slide forward end of the slide mount into the slide mount; the first bristles and the second bristles each having a base portion, a mid portion, and a forward portion; the mid portion located between the base portion and the forward portion; and the mid portion having a mid base axis; the forward portion of each of the first bristles having a first bristle angle with the mid base axis; and the forward portion of each of the second bristles having a second bristle angle with the mid base axis.

7. The coil brush of claim 6 wherein the first bristle angle is between 115° and −115°.

8. The coil brush of claim 6 wherein the first bristle angle is −90 degrees.

9. The coil brush of claim 6 wherein the first bristle angle is between −90 and −270 degrees forming a hook.

10. The coil brush of claim 6 wherein the second bristle angle is between 115° and −115°.

11. The coil brush of claim 6 wherein the second bristle angle is −90 degrees.

12. The coil brush of claim 6 wherein the second bristle angle is between −90 and −270 degrees forming a hook.

13. The coil brush of claim 6 further configured to accept a handle mounted to a head base rearward end of the head base.

14. The coil brush of claim 6 further configured to accept a handle mounted to a slide mount top side of the slide mount.

15. A coil brush comprising a brush head and a slide mount; the brush head having a head base and one or more first bristle bundles of first bristles; the slide mount having one or more slide apertures; the one or more slide apertures for the first bristle bundles of the first bristles disposed there through; and the slide mount configured to slide along the first bristles of the first bristle bundles; the coil brush further comprising one or more slides; the slide mount having one or more second bristle bundles of second bristles; each of the one or more slides having one or more bristle apertures; the second bristle bundles of the second bristles inserted through the bristle apertures of one of the slides and through a slide forward end of the slide mount into the slide mount; the first bristles and the second bristles each having a base portion, a mid portion, and a forward portion; the mid portion located between the base portion and the forward portion; and the mid portion having a mid base axis; the forward portion of each of the first bristles having a first bristle angle with the mid base axis; and the forward portion of each of the second bristles having a second bristle angle with the mid base axis.

* * * * *